US008908899B1

(12) United States Patent
Yang

(10) Patent No.: US 8,908,899 B1
(45) Date of Patent: Dec. 9, 2014

(54) EARPHONE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 14/074,733

(22) Filed: Nov. 8, 2013

(30) Foreign Application Priority Data

Aug. 29, 2013 (TW) ..... 102131070 U

(51) Int. Cl.
*H04R 25/00* (2006.01)

(52) U.S. Cl.
USPC ..... 381/384; 381/370; 381/379

(58) Field of Classification Search
CPC ..... H04R 1/10; H04R 1/105; H04R 5/0335; H04R 2201/10; H04R 2205/022
USPC ..... 381/370, 374, 379, 384
See application file for complete search history.

(56) References Cited

U.S. PATENT DOCUMENTS 7,623,667 B2 * 11/2009 Sander et al. ..... 381/384
8,787,610 B2 * 7/2014 Stevinson ..... 381/384

* cited by examiner

*Primary Examiner* — Suhan Ni
(74) *Attorney, Agent, or Firm* — Jianq Chyun IP Office

(57) ABSTRACT

An earphone is provided. The earphone includes an audio cable, a cable-splitting sheath, two earphone bodies and a slidable clipper. The audio cable includes a first cable, a second cable and a main cable. The cable-splitting sheath includes a first end and a second end opposite to each other. The first end is connected to the main cable and the second end is connected to the first cable and the second cable. The first cable and the second cable are connected to the earphone bodies respectively. The slidable clipper includes a clipping portion suitable for clipping an object so as to fix the first cable and the second cable to the object.

9 Claims, 6 Drawing Sheets

EARPHONE

CROSS-REFERENCE TO RELATED APPLICATION

This application claims the priority benefit of Taiwan application serial no. 102131070, filed on Aug. 29, 2013. The entirety of the above-mentioned patent application is hereby incorporated by reference herein and made a part of this specification.

BACKGROUND

1. Technical Field

The invention relates to an electronic product. Particularly, the invention relates to an earphone.

2. Related Art

Along with continuous development of technology, electronic products are developed towards a trend of lightweight and miniaturization, and people can use the miniaturized electronic products such as radio, MP3 player, smart phone, etc., at anywhere anytime.

Regardless of the type of the aforementioned electronic product, to facilitate the user hearing sound information provided by the electronic product without interrupting others, earphone becomes an indispensable accessory of the electronic product. Moreover, the earphone also provides a better sound transmission to a listener, and the listener can clearly hear and understand the sound content, which is superior to a situation that the sound is transmitted in the air causing the sound indistinct. Especially, when the user is in a moving state, for example, in sport, driving, intense activity or a noisy environment, the user can still hear the sound clearly by using the earphone.

However, regarding the conventional earphone, a length of an earphone line is generally designed to be very long in order to meet all kinds of users' requirement. Also, when the user uses the earphone, the earphone line is liable to sway along with the movement of the user, or even get entangled, so as to cause usage inconvenience.

SUMMARY

The invention is directed to an earphone, which increases usage convenience of a user.

The invention provides an earphone including an audio cable, a cable-splitting sheath, two earphone bodies and a slidable clipper. The audio cable includes a first cable, a second cable and a main cable. The cable-splitting sheath includes a first end and a second end opposite to each other. The first end is connected to the main cable and the second end is connected to the first cable and the second cable. The first cable and the second cable are connected to the earphone bodies respectively. The slidable clipper is slidingly sleeved on the first cable and the second cable, and is capable of sliding between the cable-splitting sheath and the earphone bodies. The slidable clipper includes a clipping portion suitable for clipping an object so as to fix the first cable and the second cable to the object.

In an embodiment of the invention, the slidable clipper further includes a closed through hole. The first cable and the second cable pass through the through hole such that the slidable clipper is sleeved on the first cable and the second cable.

In an embodiment of the invention, the slidable clipper is formed integrally.

In an embodiment of the invention, the clipping portion is an elastic piece.

In an embodiment of the invention, a material of the slidable clipper includes plastic, ceramics, metal or a combination thereof.

In an embodiment of the invention, the earphone further includes a plug, and the main cable is connected between the plug and the cable-splitting sheath.

In an embodiment of the invention, the main cable includes a first core wire and a second core wire electrically connected to the first cable and the second cable, respectively.

In an embodiment of the invention, the earphone further includes a microphone disposed on the cable-splitting sheath.

In an embodiment of the invention, the earphone further includes a microphone disposed on the main cable.

In an embodiment of the invention, the earphone further includes a microphone disposed on the first cable or the second cable.

According to the above descriptions, the slidable clipper is used to sleeve on and confine the first cable and the second cable of the audio cable, and the slidable clipper is capable of sliding between the cable-splitting sheath and the earphone bodies. In this way, the user is capable of controlling a free swaying length of the first cable and the second cable by sliding the slidable clipper, and clipping the clipping portion of the slidable clipper to, for example, the clothes of the user, so as to fix the first cable and the second cable thereon. Therefore, in the earphone of the invention, the free swaying length of the first cable and the second cable can be adjusted by the slidable clipper, and the first cable and the second cable can be temporarily fixed to an object, so as to improve usage convenience of the user.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
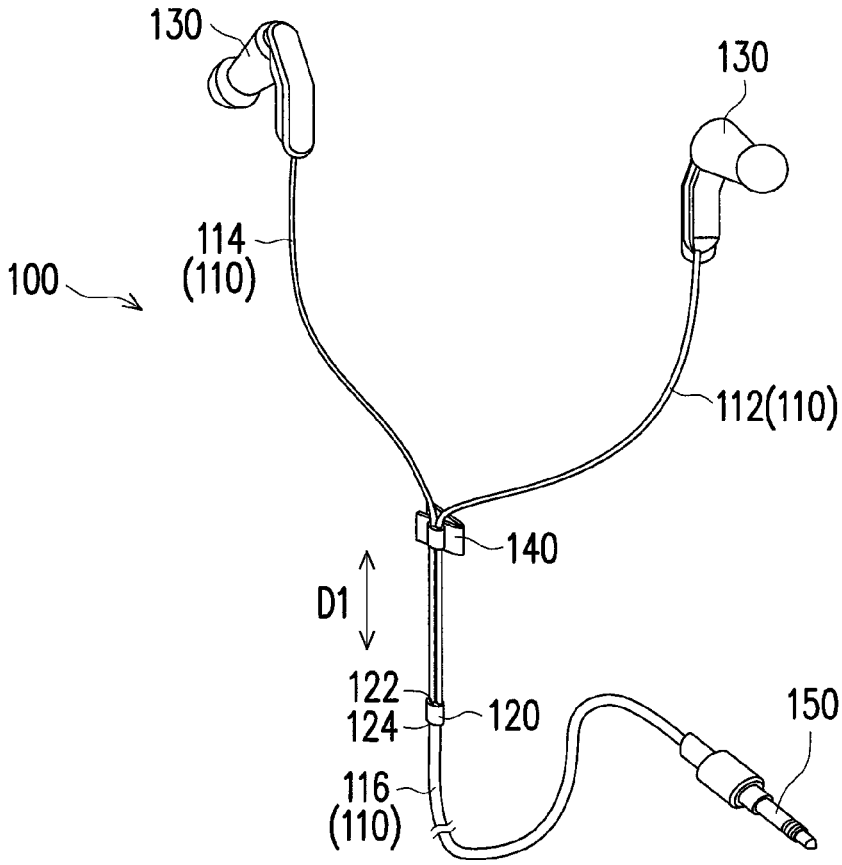
FIG. 1 is a schematic diagram of an earphone according to an embodiment of the invention.
Figure 2:
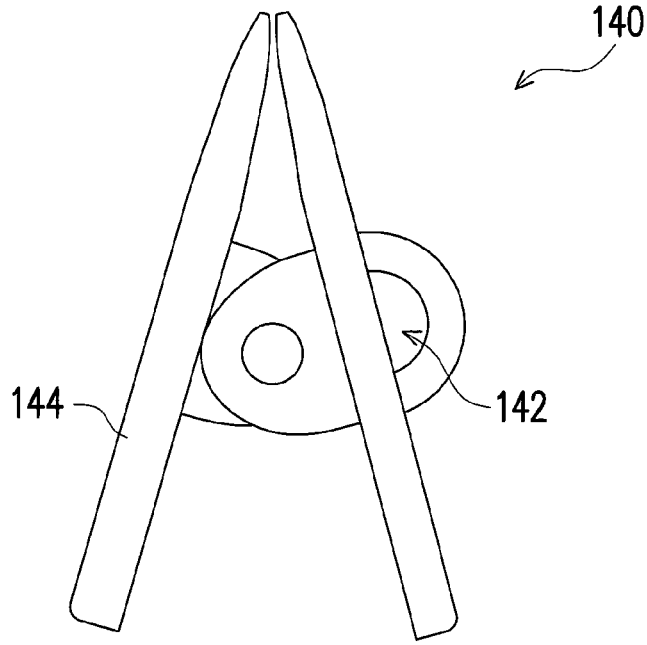
FIG. 2 is an enlarged view of a slidable clipper of FIG. 1.

FIG. 1 is a schematic diagram of an earphone according to an embodiment of the invention. FIG. 2 is an enlarged view of a slidable clipper of FIG. 1. Referring to FIG. 1 and FIG. 2, in the present embodiment, the earphone 100 includes an audio cable 110, a cable-splitting sheath 120, two earphone bodies 130 and a slidable clipper 140. In the present embodiment, the earphone 100 can be an in-ear type earphone. The audio cable 110 includes a first cable 112, a second cable 114 and a main cable 116. The cable-splitting sheath 120 includes a first end 122 and a second end 124 opposite to each other. The first end 122 is connected to the main cable 116 and the second end 124 is connected to the first cable 112 and the second cable 114.

In detail, the main cable 116 may include a first core wire and a second core wire. The earphone 100 further includes an insulation material, which covers outer surfaces of the first cable 112, the second cable 114 and the main cable 116. In the present embodiment, the first core wire and the second core wire may be respectively a right channel wire and a left channel wire which are electrically connected to the first cable 112 and the second cable 114, respectively, and the first cable 112 and the second cable 114 are respectively connected to the earphone bodies 130.

In an embodiment of the invention, the earphone 100 further includes a plug 150, and the main cable 116 is connected between the plug 150 and the cable-splitting sheath 120, and the plug 150 is used for connecting an external power supply or external electronic device, for example, an MP3 player or a smart phone, etc. Of course, the present embodiment is merely for illustration, and the invention is not limited thereto.

The slidable clipper 140 further includes a through hole 142 and a clipping portion 144, where the first cable 112 and the second cable 114 pass through the through hole 142, such that the slidable clipper 140 is slidably sleeved on the first cable 112 and the second cable 114, and is capable of sliding between the cable-splitting sheath 120 and the earphone bodies 130. In the present embodiment, the through hole 142 is a closed through hole 142. Here, the closed through hole 142 refers to that a sidewall of the through hole 142 defined by the slidable clipper 140 does not have any gap and presents an integral ring shape, though the invention is not limited thereto. The slidable clipper 140 wraps and confines the first cable 112 and the second cable 114 in the through hole 142, and the first cable 112 and the second cable 114 between the earphone bodies 130 and the slidable clipper 140 that are not confined by the slidable clipper 140 may sway freely. In this way, the user can control a free swaying length of the first cable 112 and the second cable 114 by sliding the slidable clipper 140 along a sliding direction D1. When the user slides the slidable clipper 140 to a proper position, the user can clip the clipping portion 144 to an object to fix the position of the slidable clipper 140, so as to fix the first cable 112 and the second cable 114 on the object. In the present embodiment, the user may clip the clipping portion 144 on the clothes of the user. Of course, the invention is not limited thereto.

In detail, the clipping portion 144 of the slidable clipper 140 can be an elastic piece, and a material of the slidable clipper 140 can be plastic, ceramics, metal or a combination thereof. For example, the slidable clipper 140 may be fabricated through a method of embedding metal in ceramics, embedding metal in plastic, or can be formed integrally by adopting injection molding technology. Of course, the invention is not limited thereto. In other embodiments, the clipping portion 144 may also be a separated independent component, which is connected to a body of the slidable clipper 140.

Figure 3:
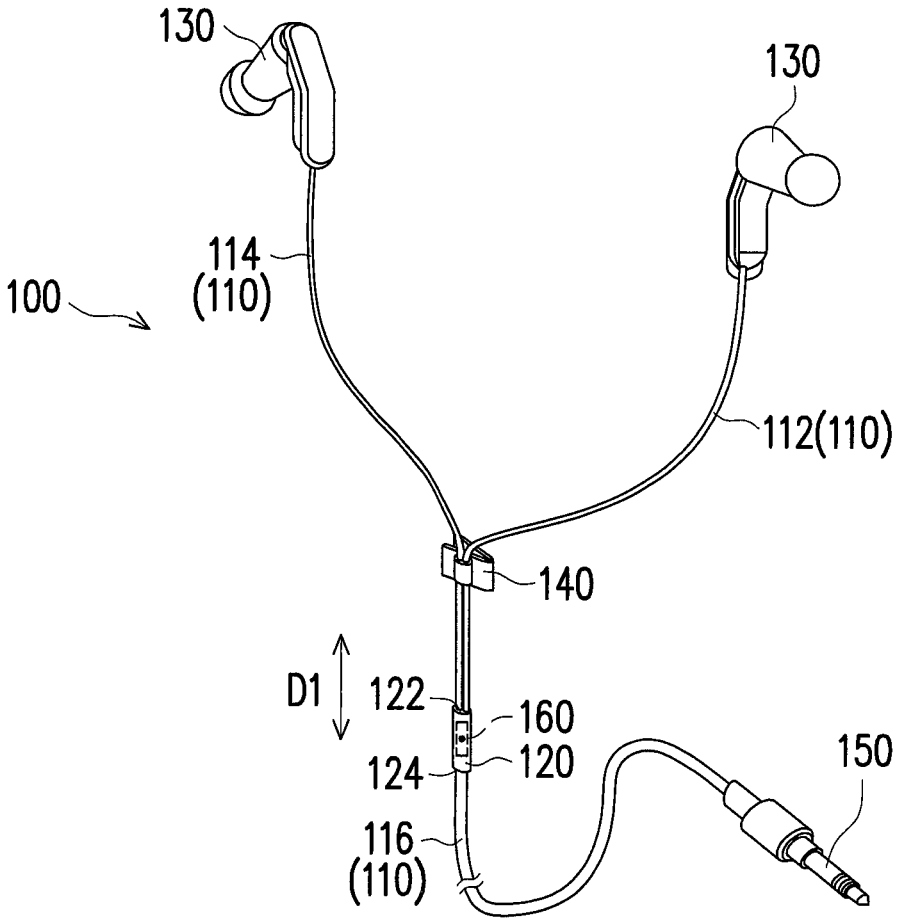
FIG. 3 to FIG. 6 are schematic diagrams of earphones of different embodiments of the invention.
Figure 4:
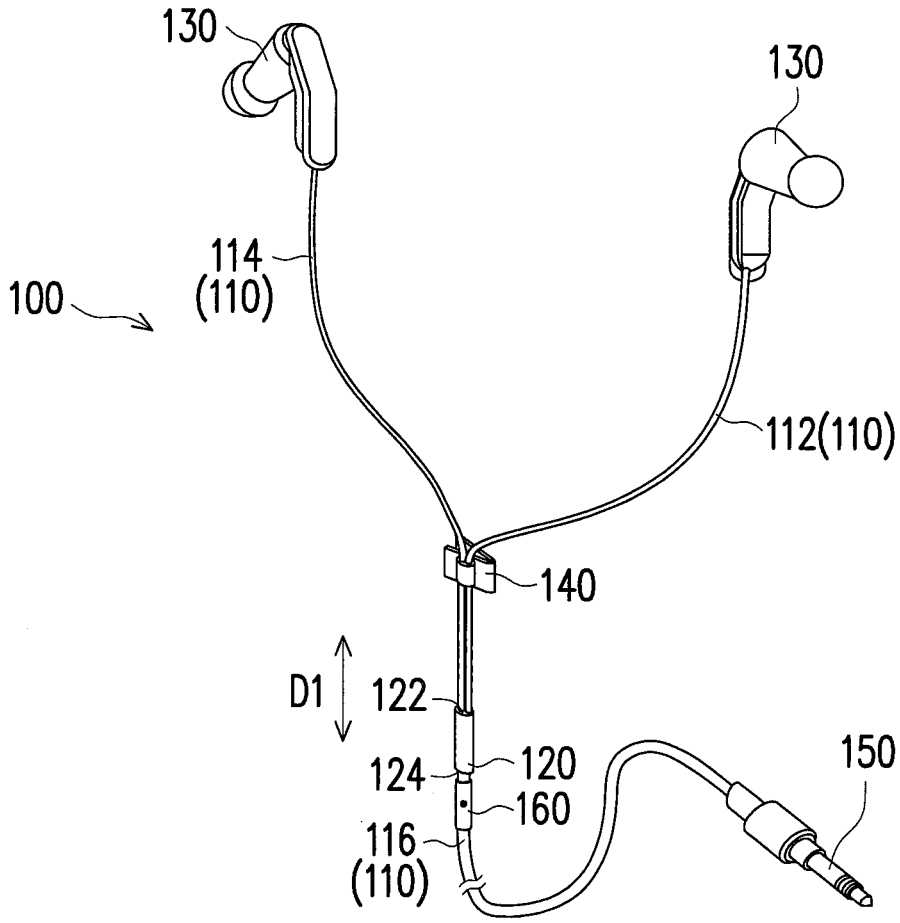
Figure 5:
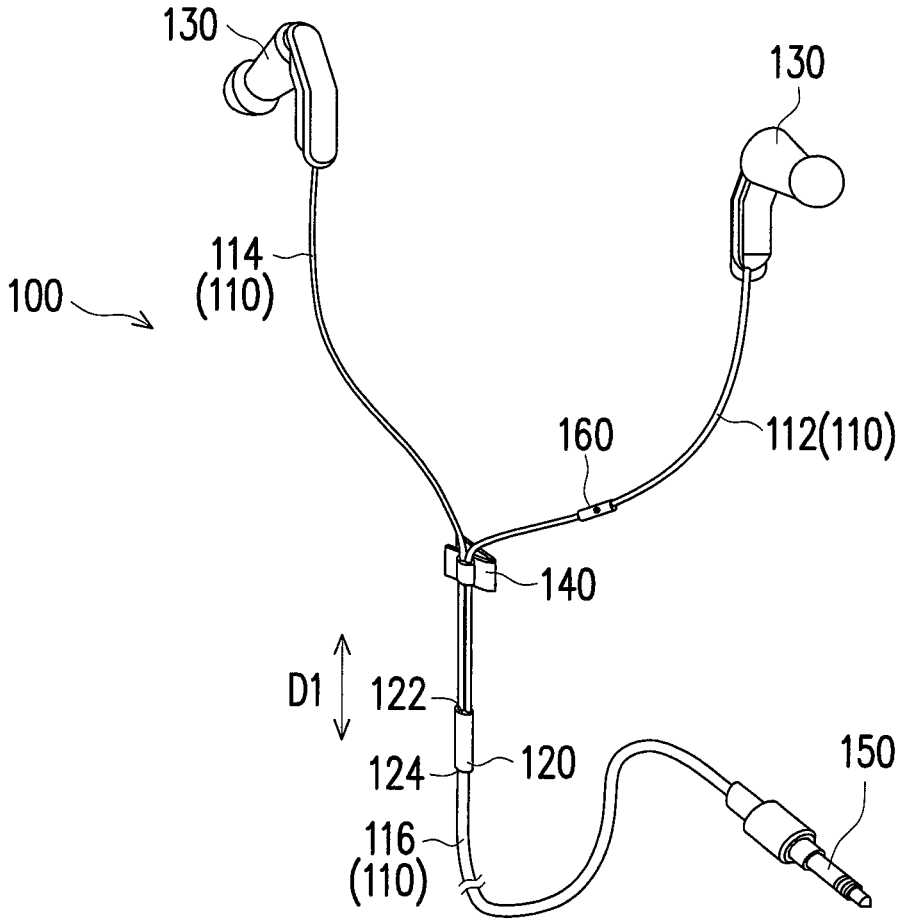
Figure 6:
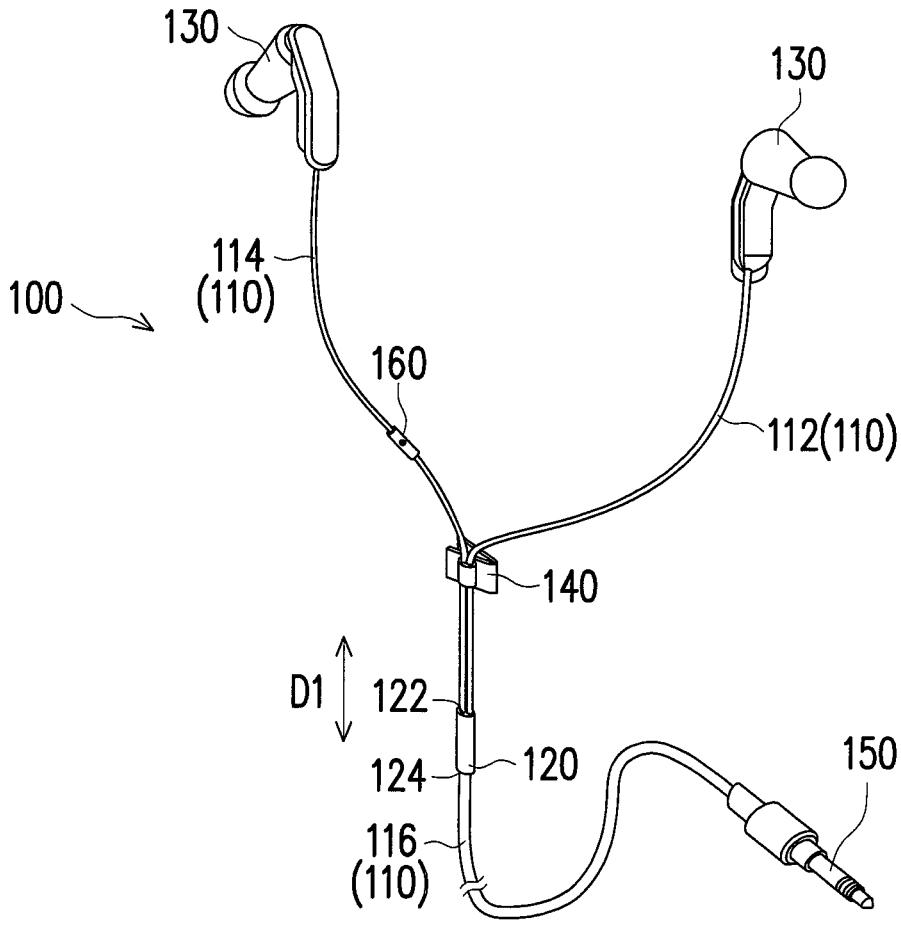

FIG. 3-FIG. 6 are schematic diagrams of earphones of different embodiments of the invention. It should be noted that the earphones shown in FIG. 3-FIG. 6 are similar to the earphone 100 of FIG. 1. Therefore, a part of content in the aforementioned embodiment may be applied in the present embodiment, and descriptions of the same technical contents are thus omitted. Descriptions of the omitted parts may refer to the aforementioned embodiment, which are not repeated herein. Referring to FIG. 3, the earphone further includes a microphone 160, which is used for receiving a sound signal generated by an external sound source. In the present embodiment, the microphone 160 is disposed on the cable-splitting sheath 120 to, for example, receive sound from the user. In other embodiments of the invention, the microphone 160 may also be disposed on the main cable 116 as that shown in FIG. 4, or the microphone 160 may be disposed on the first cable 112 or the second cable 114 as that shown in FIG. 5 or FIG. 6.

The earphone 100 of the aforementioned embodiment is an in-ear earphone, by which the size of the earphone bodies 130 is decreased, and sound outputting ends are disposed deeply into ear canals of the user, and earplugs are used to cover the earphone bodies 130, such that elastic deformation of the earplugs may accommodate to ear canals of different users. The earphone bodies of the in-ear earphone 100 can be used to seal the ear canals of the user, so as to isolate the external sound to improve a sound transmitting quality. Of course, the invention is not limited thereto. In the following embodiment, the earphone may also be a circum-aural earphone. Different from in-ear earphone that is required to be disposed into the ear canal of the user, two earmuffs of the on-ear earphone is generally connected by an arc bracket, and when the user wears the earphone, the two earmuffs may cover the ears of the user without entering the ear canals of the user. Such design may effectively block the external noises, and the user may still clearly hear the music with rather small volume, so as to avoid damaging user's auditory nerve.

Figure 7:
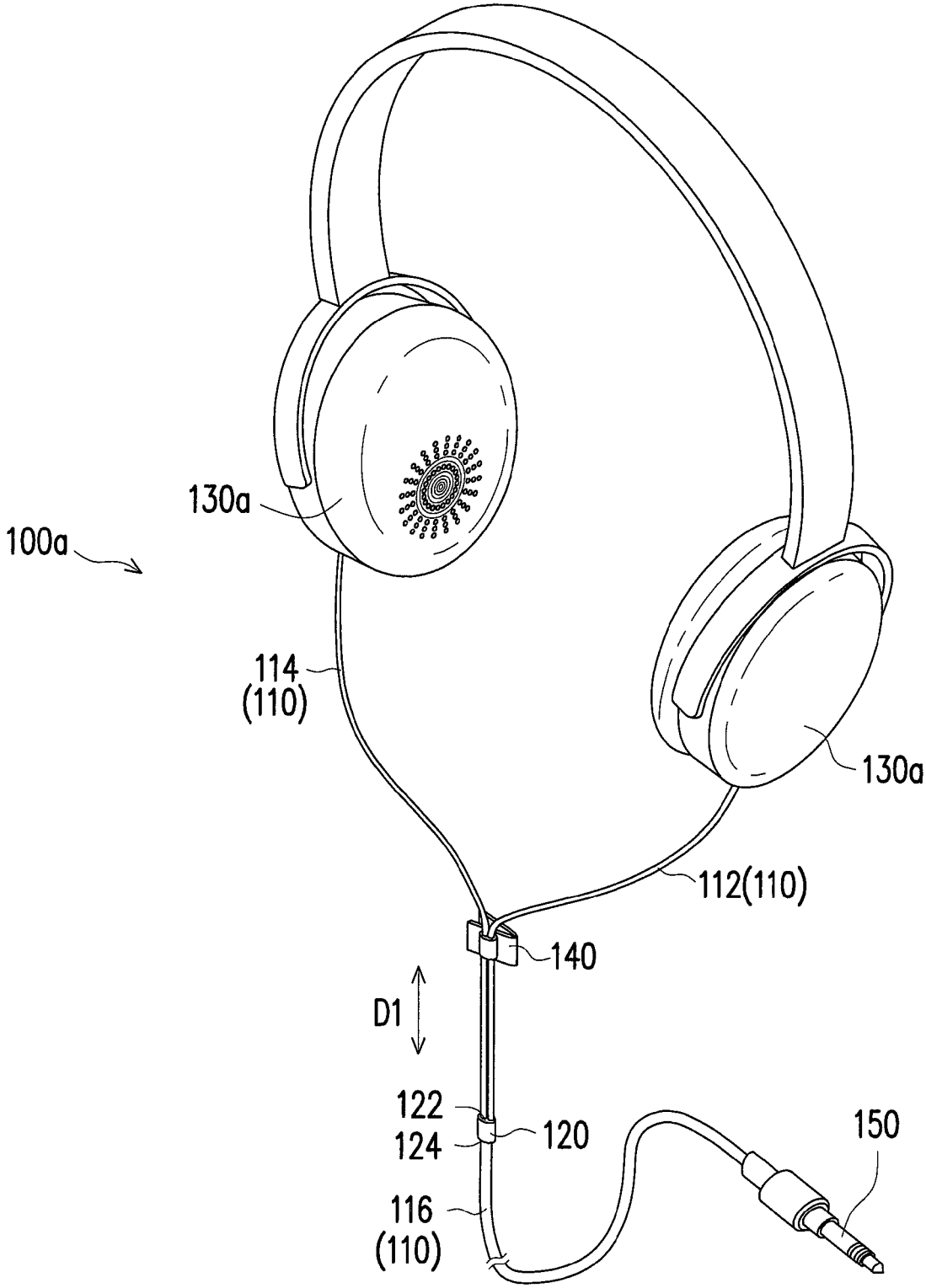
FIG. 7 is a schematic diagram of an earphone according to another embodiment of the invention.

FIG. 7 is a schematic diagram of an earphone according to another embodiment of the invention. The earphone 100*a* of the present embodiment is similar to the earphone 100 of FIG. 1, therefore, a part of content of the aforementioned embodiment is applied in the present embodiment, and descriptions of the same technical contents are thus omitted. Descriptions of the omitted parts may refer to the aforementioned embodiment, which are not repeated herein. Referring to FIG. 2 and FIG. 7, in the present embodiment, the earphone 100*a* is an on-ear earphone, which includes the audio cable 110, the cable-splitting sheath 120, two earphone bodies 130 and the slidable clipper 140. The audio cable 110 includes the first cable 112, the second cable 114 and the main cable 116. The cable-splitting sheath 120 includes the first end 122 and the second end 124 opposite to each other. The first end 122 is connected to the main cable 116 and the second end 124 is connected to the first cable 112 and the second cable 114.

The first cable 112 and the second cable 114 are respectively connected to the earphone bodies 130*a*. In the present embodiment, the earphone bodies 130*a* are covering earmuffs, and the two earphone bodies 130*a* are connected by an arc bracket as that shown in FIG. 7. Of course, the embodiment of FIG. 7 is merely for illustration, which is not used to limit the structure of the earphone 100*a*. In detail, as that shown in the embodiment of FIG. 2, the slidable clipper 140 may include the through hole 142 and the clipping portion 144. In the present embodiment, the through hole 142 is a closed through hole 142. Here, the closed through hole 142 refers to that a sidewall of the through hole 142 defined by the slidable clipper 140 does not have any gap and presents an integral ring shape, though the invention is not limited thereto. The first cable 112 and the second cable 114 respectively penetrate through the through hole 142, such that the slidable clipper 140 is slidably sleeved on the first cable 112 and the second cable 114, and is capable of sliding between the cable-splitting sheath 120 and the earphone bodies 130. In this way, the user can control a free swaying length of the first cable 112 and the second cable 114 by sliding the slidable clipper 140 along the sliding direction D1. When the user slides the slidable clipper 140 to a proper position, the user can clip the clipping portion 144 to an object to fix a position of the slidable clipper 140, so as to fix the first cable 112 and the second cable 114 on the object. In the present embodiment, the user may clip the clipping portion 144 on the clothes of the user. Of course, the invention is not limited thereto.

Moreover, as that shown in the embodiment of FIG. 3-FIG. 6, the earphone 100*a* may further includes a microphone (not shown) for receiving a sound signal generated by the external sound source. In the present embodiment, the microphone may be disposed on the cable-splitting sheath 120 as that shown in FIG. 3, disposed on the main cable 116 as that shown in FIG. 4, or the microphone 160 may be disposed on the first cable 112 or the second cable 114 as that shown in FIG. 5 or FIG. 6 for receiving the sound of the user.

In summary, the through hole of the slidable clipper is used to sleeve and confine the first cable and the second cable of the audio cable, and the slidable clipper is capable of sliding between the cable-splitting sheath and the earphone bodies. In this way, the user is capable of controlling a free swaying length of the first cable and the second cable by sliding the slidable clipper along directions away from or closing to the cable-splitting sheath. Moreover, after the user slides the slidable clipper to a proper position, and clips the clipping portion of the slidable clipper to, for example, the clothes of the user, the position of the slidable clipper is fixed, so as to fix the first cable and the second cable thereon. Therefore, in the earphone of the invention, the free swaying length of the first cable and the second cable can be effectively adjusted through the slidable clipper, and the first cable and the second cable can be temporarily fixed to an object, so as to improve usage convenience of the user.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An earphone, comprising:

an audio cable, comprising a first cable, a second cable and a main cable;

a cable-splitting sheath, comprising a first end and a second end opposite to each other, wherein the first end is connected to the main cable and the second end is connected to the first cable and the second cable;

two earphone bodies, wherein the first cable and the second cable are connected to the earphone bodies, respectively; and a slidable clipper, slidingly sleeved on the first cable and the second cable, and capable of sliding between the cable-splitting sheath and the earphone bodies, wherein the slidable clipper comprises a clipping portion suitable for clipping an object so as to fix the first cable and the second cable to the object.

2. The earphone as claimed in claim 1, wherein the slidable clipper further comprises a closed through hole, and the first cable and the second cable pass through the through hole.

3. The earphone as claimed in claim 1, wherein the slidable clipper is formed integrally.

4. The earphone as claimed in claim 1, wherein the clipping portion is an elastic piece.

5. The earphone as claimed in claim 1, wherein a material of the slidable clipper comprises plastic, ceramics, metal or a combination thereof.

6. The earphone as claimed in claim 1, further comprising a plug, and the main cable is connected between the plug and the cable-splitting sheath.

7. The earphone as claimed in claim 1, further comprising a microphone disposed on the cable-splitting sheath.

8. The earphone as claimed in claim 1, further comprising a microphone disposed on the main cable.

9. The earphone as claimed in claim 1, further comprising a microphone disposed on the first cable or the second cable.

* * * * *